US006330423B1

(12) United States Patent
Kitazawa

(10) Patent No.: US 6,330,423 B1
(45) Date of Patent: Dec. 11, 2001

(54) IMAGE FORMING APPARATUS

(75) Inventor: Osamu Kitazawa, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/631,667

(22) Filed: Aug. 3, 2000

(51) Int. Cl.[7] ..... G03G 15/00
(52) U.S. Cl. ..... 399/392; 271/145; 399/45
(58) Field of Search ..... 399/392, 390, 399/393, 81, 45, 110, 107, 126; 271/145, 162

(56) References Cited

U.S. PATENT DOCUMENTS 5,454,555 * 10/1995 Kiyohara et al. ..... 271/145 X

FOREIGN PATENT DOCUMENTS 05-017037 * 1/1993 (JP) .
05-092846 * 4/1993 (JP) .
6-305595 11/1994 (JP) .
07-109052 * 4/1995 (JP) .
08-104449 * 4/1996 (JP) .
08-113379 * 5/1996 (JP) .

* cited by examiner

*Primary Examiner*—Sophia S. Chen
(74) *Attorney, Agent, or Firm*—Foley & Lardner

(57) ABSTRACT

The ability of manual paper feeders to cope with increasing types of paper sheets (particularly basis weights) is approaching its limit. In this invention, when an operator performs a simple operation of, e.g., selecting the type of paper sheet on an operation panel, paper feed mechanism conditions at a manual paper feed port are optimized. That is, a manual paper feed tray desirably capable of being accommodated in a main body automatically changes its position and angle with respect to the main body in accordance with external inputs from an operator, thereby changing the paper feed mechanism conditions. This allows stable paper feed/conveyance of a variety of types of paper sheets and realizes space saving and low cost.

10 Claims, 6 Drawing Sheets

IMAGE FORMING APPARATUS

BACKGROUND OF THE INVENTION

The present invention relates to an image forming apparatus.

Many image forming apparatuses such as electronic copying machines have a manual paper feeder in addition to an automatic cassette paper feeder. Commonly, this manual paper feeder is used to temporarily feed to the main body a paper sheet of a type outside the specification of an automatic paper feed tray. The basic position of such a manual paper feeder remains unchanged at present.

Recently, however, demands on manual paper feeders are more and more increasing. That is, manual paper feeders are required not only to correspond to various types of paper sheets (particularly basis weights) but also to continuously feed a plurality of paper sheets like automatic paper feeders.

These requirements have been conventionally met by adjusting the position, material, shape, and pressing force of each of a paper pickup roller for picking up a paper sheet, a paper feed roller for feeding the picked-up sheet to the main body, and a brake pad for stopping the sheet, as the basic components of a manual paper feeder, or by adjusting the position, angle, guide angle, and the like of a paper stack tray.

Unfortunately, the adjustment of these components such as the paper pickup roller, paper feed roller, brake pad, and paper stack tray cannot unlimitedly cope with diverse types of paper sheets.

Major problems are as follows.

(1) To reliably separate and feed paper sheets having a high friction coefficient between them, a pre-separation function such as an inclined separation guide must be placed before a separation mechanism. However, when the paper feed properties of thick paper sheets are taken into consideration, the guide shape of a paper conveyor for conveying paper sheets must be infinitely approached to a straight line. This contradiction makes it difficult to obtain an appropriate angle meeting the two requirements.

(2) When a condition such as a thickness changes, the friction coefficient and the paper feed property change. Hence, it is difficult to accurately separate and feed such a plurality of types of paper sheets.

In some conventional apparatuses, a manual paper feeder has a tray with an elevating function which can move up and down in accordance with the number or basis weight of paper sheets, like an automatic cassette paper feeder. This system can always maintain the posture of a paper sheet in a stable state regardless of changes in the number or basis weight of paper sheets.

The mechanism, however, of this manual paper feeder becomes complicated and increases in size like an automatic paper feeder. This is a disadvantage in seeking the space utility of an apparatus as a whole.

The present invention has been made in consideration of the above situation, and has as its object to provide an image forming apparatus capable of reliably separating and feeding different types of paper sheets to the main body, with a simple mechanism which can be made small.

SUMMARY OF THE INVENTION

An image forming apparatus of the present invention comprises a paper feed tray, wherein a supporting point position and angle of the paper feed tray change in accordance with an external input.

The paper feed tray can be a manual paper feed tray.

The external input can be given when an operator performs a predetermined input operation on an operation panel.

Alternatively, the external input can be manually given by an operator.

An image forming apparatus of the present invention comprises a paper feed tray on which a paper sheet to be manually fed is placed, wherein a mounting position of the manual paper feed tray with respect to an apparatus main body is adjusted in accordance with the type of paper sheet placed on the paper feed tray.

The apparatus can also be constructed such that the manual paper feed tray comprises a tray for stacking paper sheets, a pair of supporting point members formed at two ends of a leading end portion in a conveyance direction of the tray, a gear being formed in at least a partial circumferential region centering around a first rotation supporting point, a support shaft formed along the first rotation supporting point and having a pair of projections protruding from the supporting point members toward two ends, a pair of rack guides fixed to a main body and having racks which mesh with the gears of the supporting point members and long holes elongated in one direction into which the projections are inserted, a pair of lever gears which rotate around a second rotation supporting point while engaging, with play, with the projections inserted into the long holes and protruding toward two ends, and a driving source for rotating the lever gears, and that when the external input is given, the driving source rotates the lever gears around the second rotation supporting point, the lever gears drive the projections engaged around the second rotation supporting point, the projections slidably move along the long holes in the rack guides fixed to the main body, and the position of the first rotation supporting point moves while the supporting point members rotate around the first rotation supporting point, thereby changing the supporting point position and angle of the manual paper feed tray.

The driving source can comprise a motor.

The supporting point members can have fan-shaped holes centering around the first rotation supporting point, the tray can have fan-shaped projections to be inserted with play into the fan-shaped holes around the first rotation supporting point, and the tray can be accommodated in the main body of the image forming apparatus when the fan-shaped projections pivot in the fan-shaped holes.

The above image forming apparatuses can cope with a variety of types of paper sheets by changing the supporting point position and angle of the paper feed tray by an external input in accordance with the type of paper sheet.

Also, when a conventional elevating function is given to a manual paper feed tray, the mechanism becomes complicated and increases in size. The present invention, however, uses a simple arrangement by which a manual paper feed tray itself changes its supporting point position and angle. Consequently, a paper sheet can be fed in optimum conditions corresponding to the type of paper sheet.

DESCRIPTION OF THE PREFERRED EMBODIMENT

An embodiment of the present invention will be described below with reference to the accompanying drawings.

Figure 1:
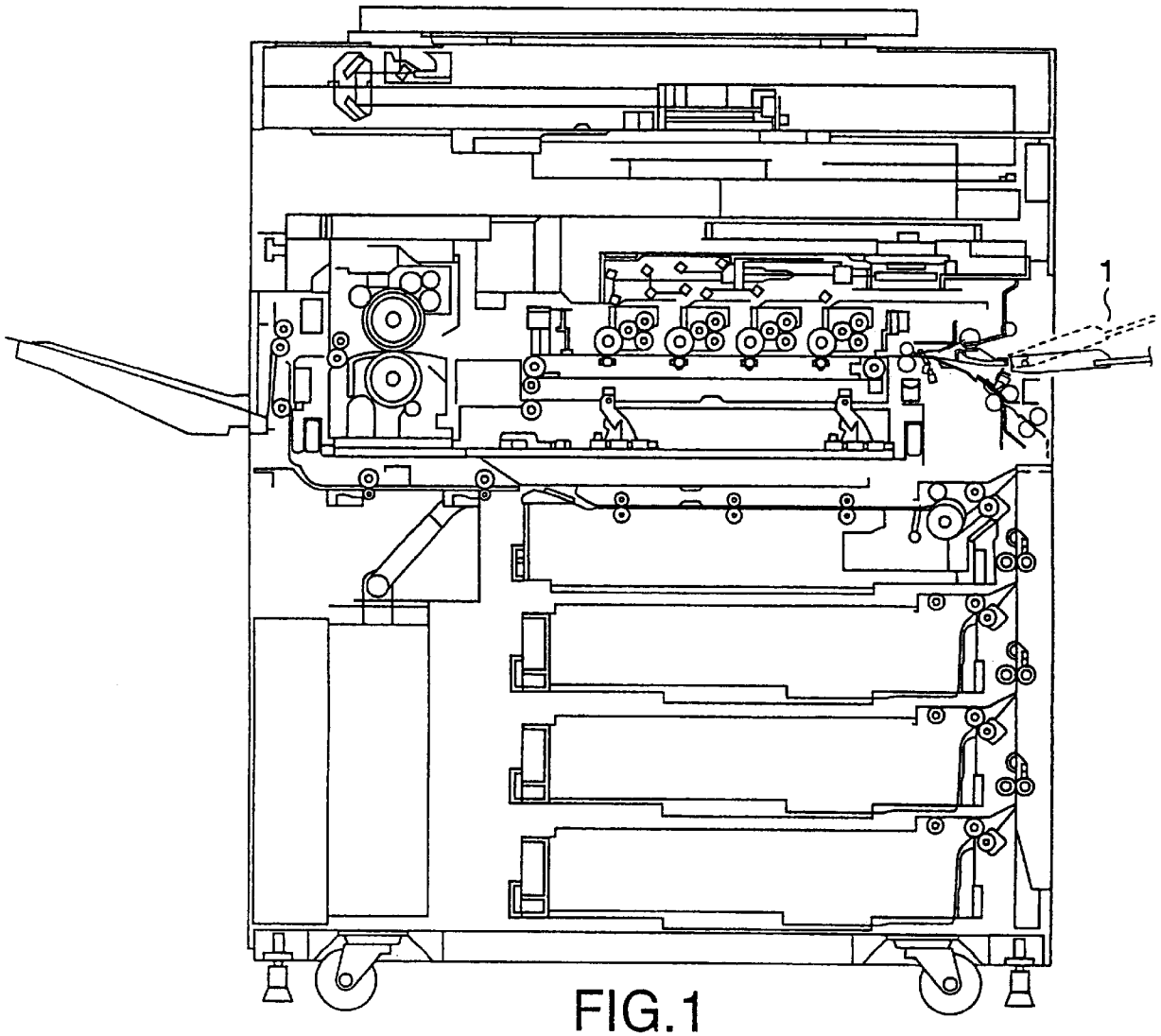
FIG. 1 is a sectional view showing the longitudinal section viewed from the front of an image forming apparatus to which the present invention is applicable.

FIG. 1 shows a longitudinal section when an image forming apparatus to which the present invention is applicable is viewed from the front. The front side of the apparatus is defined as a side on which an operation panel of the apparatus main body is installed. The back side is opposite to this side.

Figure 2:
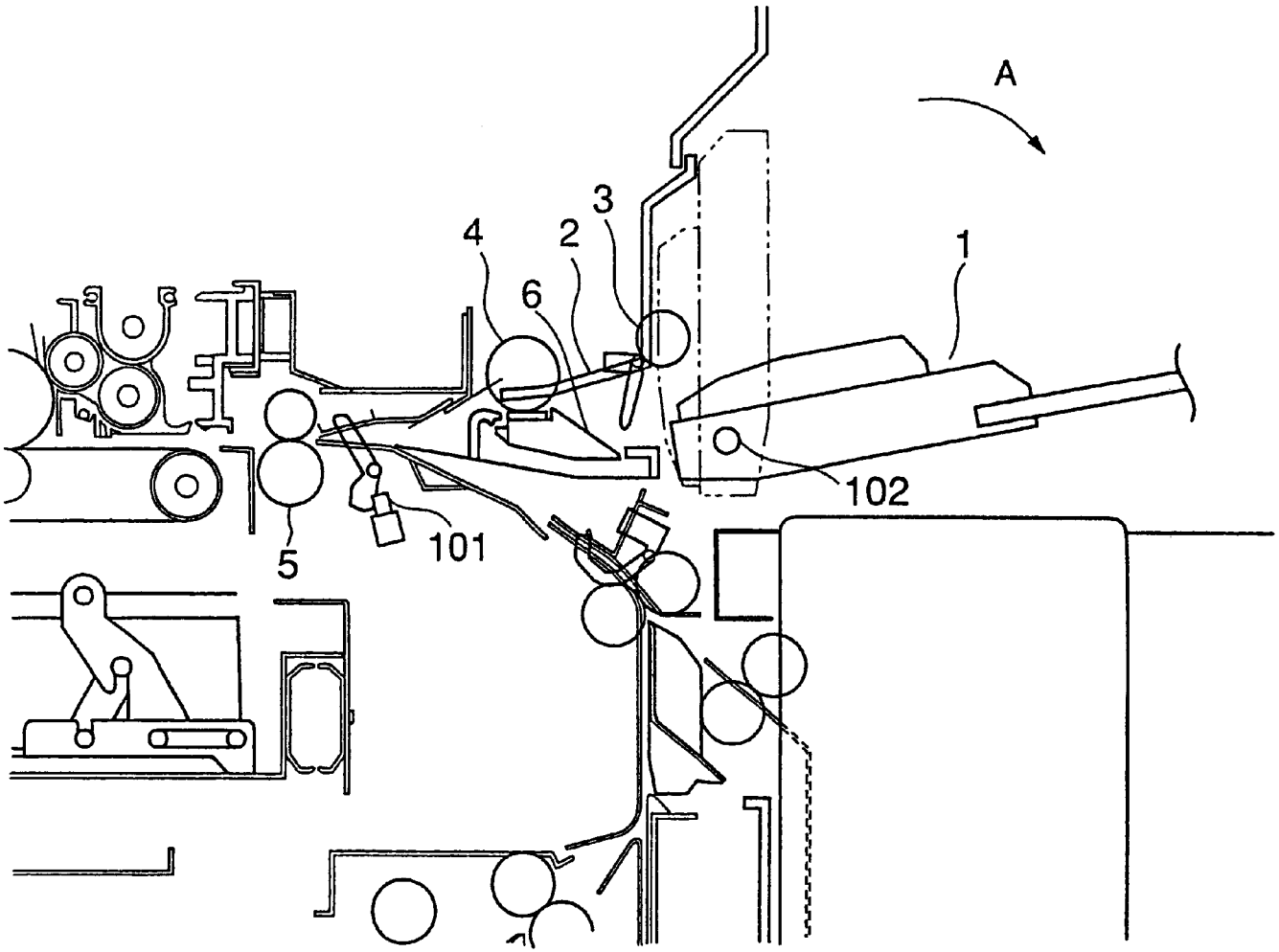
FIG. 2 is a longitudinal sectional view showing the arrangement of a manual paper feeder of an image forming apparatus according to one embodiment of the present invention.

First, a paper feed operation of a manual paper feeder will be explained. Referring to FIG. 1, a manual paper feed tray 1 of this manual paper feeder is normally accommodated in the main body of the image forming apparatus, and this manual paper feed tray 1 is in a wingless state. When an operator wants to manually feed a paper sheet, therefore, he or she opens the manual paper feed tray 1 by pivoting it in the direction of an arrow A in FIG. 2 until a predetermined posture is obtained.

To copy, the operator then places a paper sheet on the manual paper feed tray 1. When a sheet sensor 2 senses the presence of the paper sheet, a paper feed activation switch turns on. Consequently, a pickup roller 3 for picking up a paper sheet and a paper feed roller 4 rotate.

At the same time or at a slightly delayed timing, the pickup roller 3 moves down to the position on the manual paper feed tray 1 while rotating around the paper feed roller 4, thereby starting a paper feed operation.

When the paper sheet is fed into the main body, the leading edge of the paper sheet turns on a switch 101 before a position adjusting roller. After a predetermined time interval from the ON timing of this switch 101, the pickup roller 3 and the paper feed roller 4 stop rotating. When the paper sheet is slightly pushed while its leading edge abuts against the nip of a position adjusting roller 5, the position of the paper sheet is adjusted, and the pickup roller 3 and the paper feed roller 4 stop operating. The manual paper feeder participates in the paper feed operation up to this point.

An operation by which the manual paper feed tray 1 changes the height of a support shaft 102 and the angle of the tray in accordance with the type of paper sheet will be described next with reference to FIG. 3. In this embodiment, assume that the manual paper feed tray changes its position and angle in two ways in accordance with two types of paper sheets. If the number of paper sheet types increases and the supporting point position (the position of the support shaft 102) and angle of the manual paper feed tray must be changed in three or more ways, those skilled in the art can readily apply the present invention on the basis of this embodiment.

Figure 3:
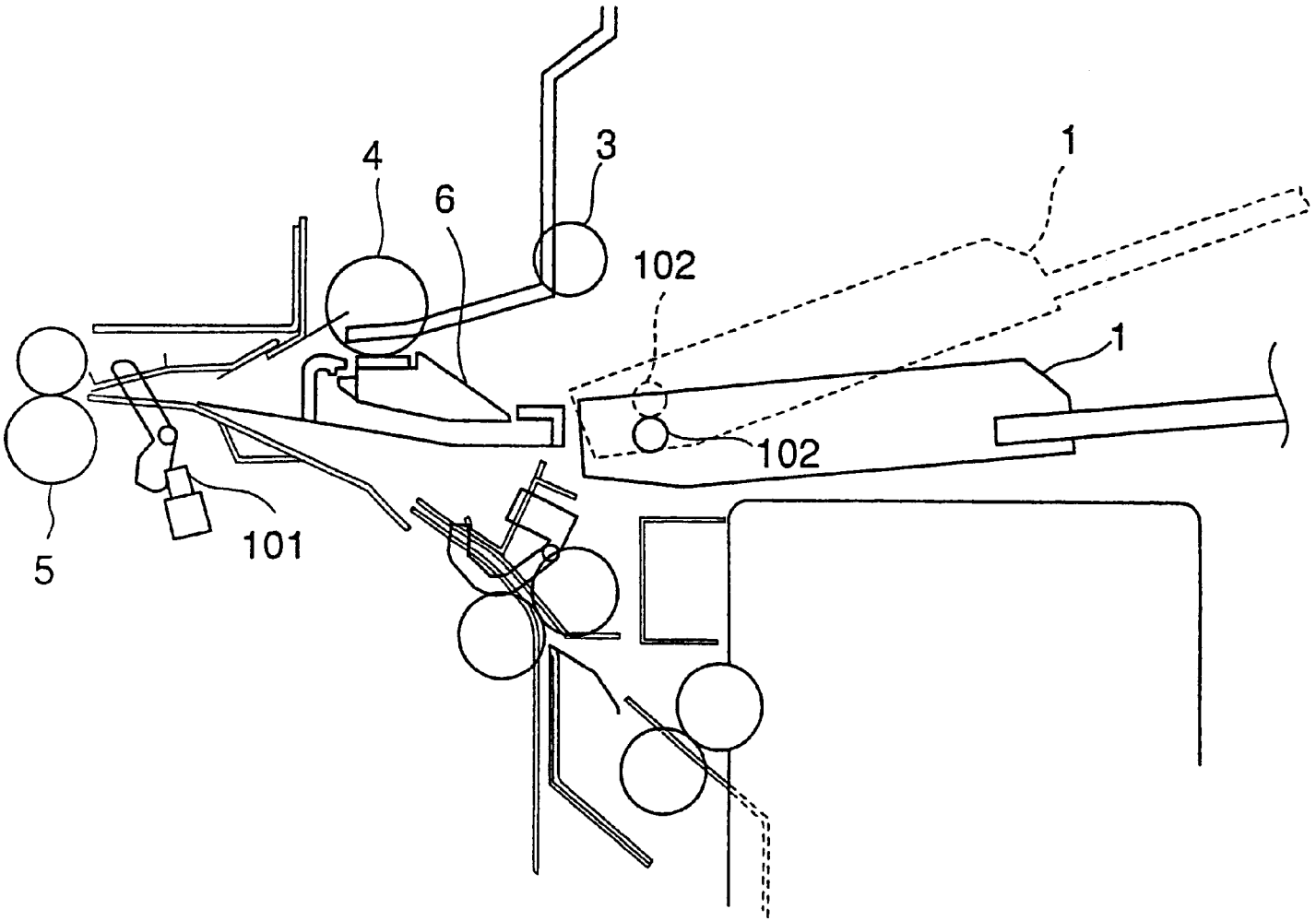
FIG. 3 is a longitudinal sectional view showing changes in the height and angle of a manual paper feed tray of the manual paper feeder.

Referring to FIG. 3, the supporting point position and angle of the manual paper feed tray 1 indicated by the solid lines are in a state in which paper sheets from a plain paper sheet to a thick paper sheet which is relatively thin (e.g., its basis weight is approximately 140 g/m$^2$ or less) are continuously fed. This state is a default state.

To feed firm paper sheets such as a paper sheet (having a basis weight of, e.g., about 141 g/m$^2$ or more) thicker than those which can be fed in the default state, an operator selects a thick paper mode on the operation panel or the like. Consequently, the manual paper feed tray 1 moves up and pivots at the same time to change the height and angle of the support shaft 102, thereby setting a thick paper feed state.

This is based on the experimental results. That is, to feed and convey a thick paper sheet, it is desirable that the supporting point position of the manual paper feed tray 1 be high and its inclination angle be large in order to raise the trailing edge of the sheet. Conversely, to feed paper sheets from a plain paper sheet to a thick paper sheet which is relatively thin, it is preferable that the supporting point position of the manual paper feed tray 1 be low and its inclination angle be small and close to level.

As described above, the manual paper feed tray 1 itself moves up/down and pivots. To continuously feed plain paper sheets, the inclination of the manual paper feed tray 1 is decreased, and its supporting point position makes the most of the sheet loosening action of a guide portion 6 (see FIGS. 2 and 3) with an inclined plate, which is positioned before the mechanism of separating paper sheets.

To feed one firm paper sheet such as a thick paper sheet, the inclination of the manual paper feed tray 1 is increased to enhance the conveyance force of the pickup roller 3. Also, the supporting point position of the manual paper feed tray 1 is raised to convey the paper sheet straight to the separating mechanism, thereby reducing the conveyance load.

Figure 4A:
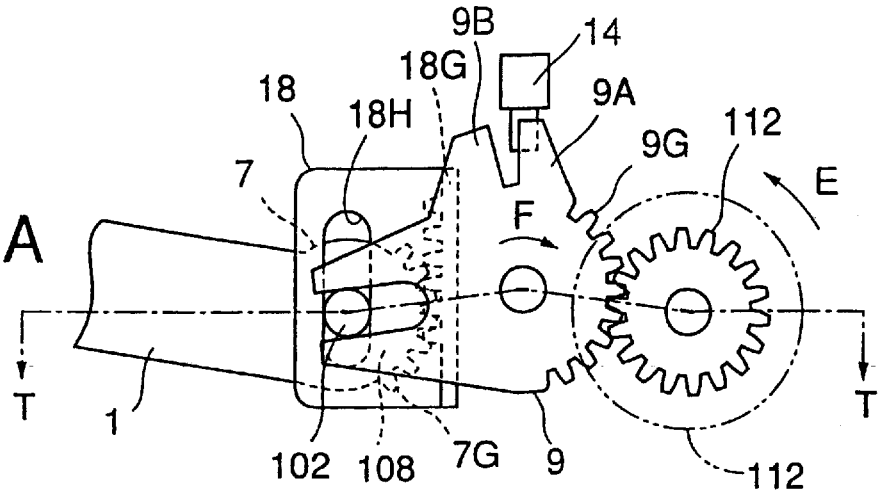
FIG. 4A is a sectional view showing the longitudinal section viewed from the back of a driving mechanism of the manual paper feed tray in a default state.
Figure 4B:
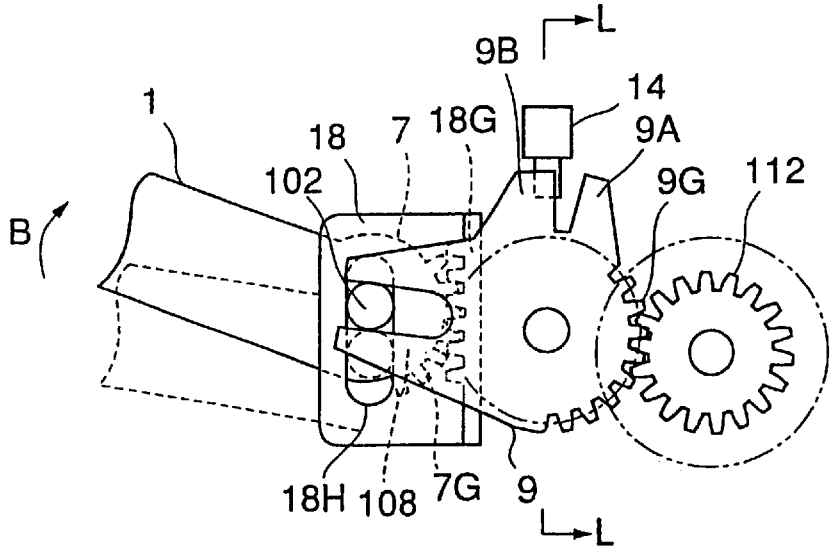
FIG. 4B is a longitudinal sectional view showing the driving mechanism of the manual paper feed tray viewed from the back in a thick paper feed state.
Figure 5:
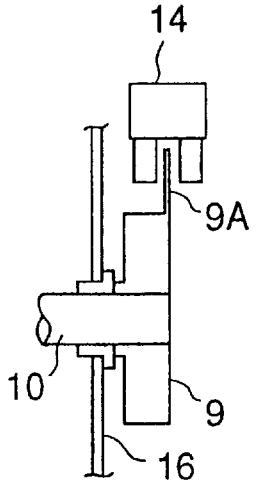
FIG. 5 is a sectional view showing a longitudinal section taken along a line L—L in FIG. 4B.
Figure 6:
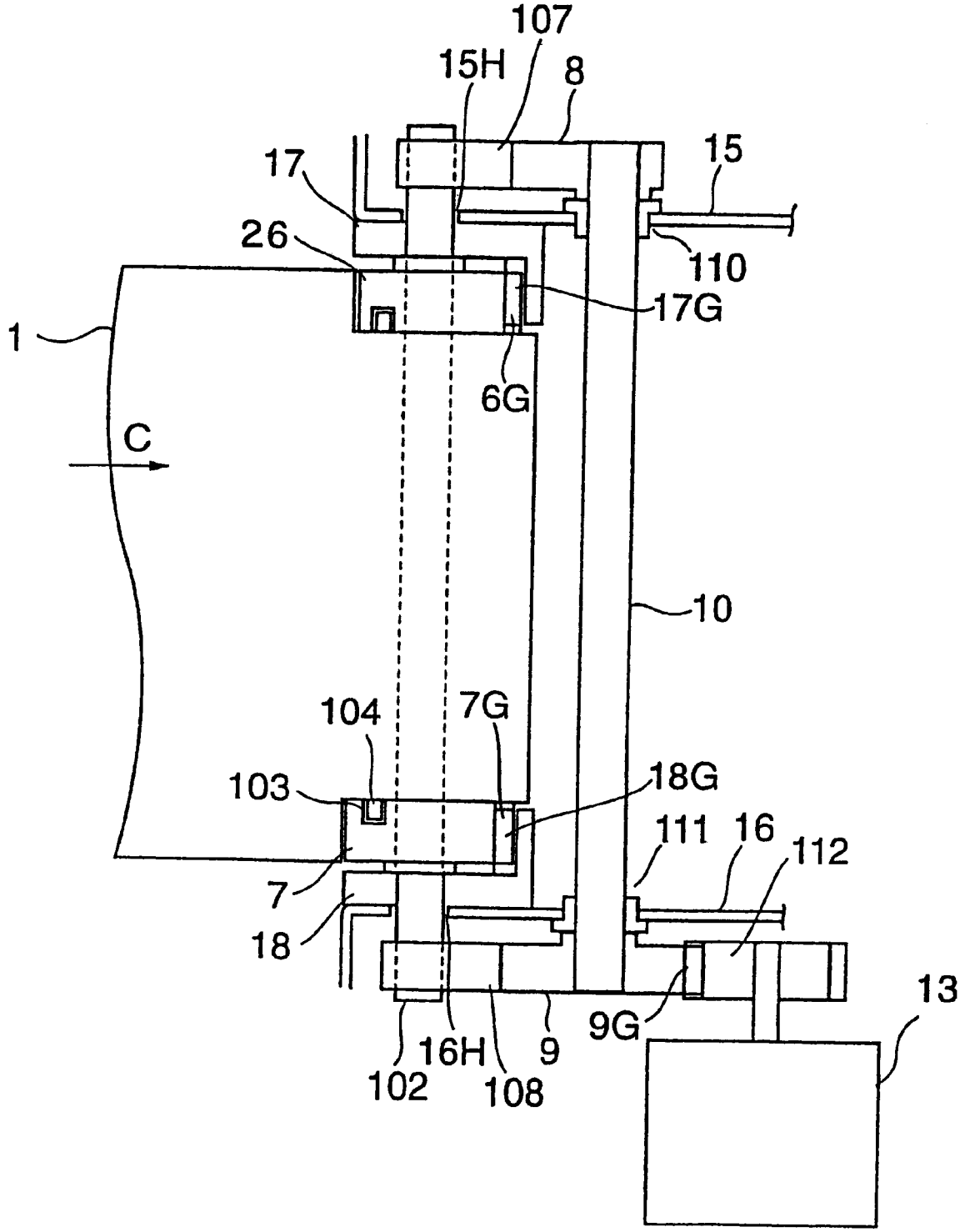
FIG. 6 is a sectional view showing a cross section taken along a line T—T in FIG. 4A, in which the structure of a supporting point of the manual paper feed tray is illustrated.

A practical mechanism for changing the position and angle of the support shaft 102 of the manual paper feed tray 1 will be described below with reference to FIGS. 4A, 4B, 5, and 6. FIGS. 4A and 4B are longitudinal sectional views when the driving mechanism of the manual paper feed tray 1 is viewed from the back; FIG. 4A shows the default state, and FIG. 4B shows the thick paper feed state. FIG. 5 is a sectional view showing a longitudinal section taken along a line L—L in FIG. 4B. FIG. 6 shows a cross section taken along a line T—T in FIG. 4A. FIG. 6 is a detailed view showing the structure around the support shaft 102 of the manual paper feed tray.

Supporting point members 26 and 7 are attached to the 20 left- and right-hand end portions, in a manual feed direction indicated by an arrow C in FIG. 6, of the manual paper feed tray 1. Referring to FIGS. 4A and 4B, the manual paper feed tray 1 and the supporting point members 26 and 7 are drawn as an integrated structure for the sake of easy understanding.

As shown in FIGS. 4A and 4B, the supporting point members 26 and 7 are formed on the basis of the rotating center (the rotating center of the support shaft 102) when the manual paper feed tray 1 pivots in the direction of an arrow B. These supporting point members 26 and 7 are parts having shapes symmetrical to each other.

Figure 7A:
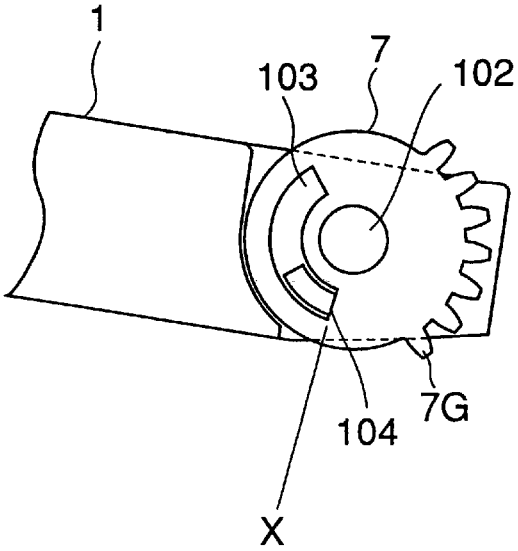
FIG. 7A is a sectional view showing a longitudinal sectional structure when the manual paper feed tray is pulled out from the main body so that paper sheets can be fed.
Figure 7B:
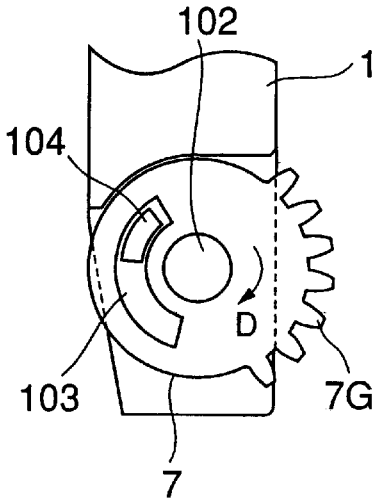
FIG. 7B is a sectional view showing a longitudinal sectional structure when the manual paper feed tray is housed in the main body.

The supporting point members 26 and 7 rotate around holes, consistent with the rotating center of the support shaft 102, which are formed as bearing holes. Gears 6G and 7G are formed in front portions of these supporting point members 26 and 7, respectively. Furthermore, as shown in FIGS. 7A and 7B, fan-shaped holes 103 as bearing holes are formed in the supporting point members 26 and 7. Fan-shaped projections 104 fit in these fan-shaped holes 103 with slight play between them. The fan-shaped projections 104 are formed at the left- and right-hand ends of the front end portion of the manual paper feed tray 1 and rotate around the support shaft 102.

When the manual paper feed tray 1 is accommodated in the 5 main body, these fan-shaped projections 104 are present in upper portions of the fan-shaped holes 103 of the supporting point members 26 and 7, as shown in FIG. 7B.

This state is the end point of clockwise rotation (in the direction of an arrow D) within the movable range of the manual paper feed tray 1. In these drawings, no stopper means used when the manual paper feed tray 1 is housed in the main body is shown. However, any such means can be formed as needed. Also, the fan-shaped projections 104 have play in the clockwise direction (the direction of the arrow D) with respect to the fan-shaped holes 103 in the supporting point members 26 and 7. Since the supporting point members 26 and 7 having this structure are formed as parts separated from the manual paper feed tray 1, the manual paper feed tray 1 can be accommodated in the main body.

Also, when the manual paper feed tray 1 is in the default 20 state, as shown in FIG. 7A, the fan-shaped projections 104 are positioned in lower portions of the fan-shaped holes 103 in the supporting point members 26 and 7. Additionally, the fan-shaped holes 103 and the fan-shaped projections 104 abut against each other on a line X, and the manual paper feed tray 1 stops. In this manner, the fan-shaped holes 103 and the fan-shaped projections 104 function as stoppers.

In this embodiment, the movable range of the manual paper feed tray 1 is the one within which the fan-shaped holes 103 and the fan-shaped projections 104 keep abutting against each other, i.e., the manual paper feed tray 1 and the supporting point members 26 and 7 keep being integrated with each other.

As shown in FIGS. 4A, 4B, and 6, the support shaft 102 of the manual paper feed tray 1 extends through long holes elongated in one direction of rack guides 17 and 18, respectively. Long hole 18H can be seen in FIG. 4A and FIG. 4B, whereby the long hole for rack guide 17 is hidden from view in those figures. The support shaft 102 further extends through holes 15H and 16H in frames 15 and 16, respectively, fixed to the main body, and is finally supported with play by notches in clamp members 107 and 108, each having a shape of claws, of lever gears 8 and 9, respectively.

The relationships between the manual paper feed tray 1, the rack guides 17 and 18, the frames 15 and 16, and the lever gears 8 and 9 will be described below.

The rack guides 17 and 18 are fixed to the frames 15 and 16, respectively. As described above, holes (see hole 18H for rack guide 18 in FIG. 4A, whereby the hole for rack guide 17 is hidden from view in that figure) elongated in one direction are formed in these rack guides 17 and 18, respectively. Each of these long holes is elongated in the vertical direction and has a dimension larger by play than the diameter of the support shaft 102 in the horizontal direction. This restricts the support shaft 102 of the manual paper feed tray 1 to some extent with certain play in the horizontal direction. Accordingly, the manual paper feed tray 1 can smoothly move in the vertical direction while its horizontal movement is regulated. Also, racks 17G and 18G to be meshed with the gears 6G and 7G of the supporting point members 26 and 7 are formed integrally with side surfaces in the vertical direction of the rack guides 17 and 18, respectively.

The holes 15H and 16H in the frames 15 and 16 through which the support shafts of the manual paper feed tray 1 extend are made larger than the long holes 17H and 18H in the rack guides 17 and 18, respectively. Therefore, play exists for the support shaft 102 of the manual paper feed tray 1.

The lever gears 8 and 9 have a symmetrical shape except for light-shielding plates 9A and 9B and a gear portion 9G of the lever gear 9. The rotating shafts of these gears 8 and 9 are supported by bearing members 110 and 111 fitted in the frames 15 and 16 with high accuracy, and are fixed to a pivotal lever shaft 10.

As shown in FIG. 4A, when the manual paper feed tray 1 is feeding a plain paper sheet (in the default state), the light-shielding plate 9A of the lever gear 9 shields light from a light-emitting means (not shown), so an optical sensor 14 cannot receive the light. In the thick paper feed state, as shown in FIG. 4B, the light-shielding plate 9B shields the light to make the optical sensor 14 unable to receive the light. Between the default state shown in FIG. 4A and the thick paper feed state shown in FIG. 4B, the light passes between the light-shielding plates 9A and 9B without being shielded, and the optical sensor 14 receives the light.

The gear portion 9G of the lever gear 9 meshes with a pinion gear 112 fixed to a motor 13 as a power source of the manual paper feeder.

The operation of the above mechanism will be described next with reference to FIGS. 4A and 4B. To take a copy on a thick paper sheet, an operator inputs instructions from outside the apparatus by operating the operation panel (to be described later). Consequently, the pinion gear 112 fixed to the motor 13 starts driving counterclockwise (in the direction of an arrow E).

This driving force rotates the lever gear 9 clockwise (in the direction of an arrow F). When the light-shielding plate 9B of the lever gear 9 rotates to a position (in FIG. 4B) where the light-shielding plate 4B shields the light to the optical sensor 14, the motor 14 stops driving. When the lever gears 8 and 9 rotate to this position, the manual paper feed tray 1 supported by the support shaft 102 in the notches of the clamp members 107 and 108 vertically rises along the long holes 17H and 18H in the rack guides 17 and 18. Simultaneously, the gears 6G and 7G of the supporting point members 26 and 7 mesh with the racks 17G and 18G of the rack guides 17 and 18, respectively, to cause pivotal motion, thereby changing the supporting point height and angle of the manual paper feed tray 1.

Conversely, when an operator inputs instructions on the operation panel to take a copy on a plain paper sheet, the motor 13 drives clockwise in contrast to the case in which a copy is to be taken on a thick paper sheet. This returns the manual paper feed tray 1 to the default position. The motor 13 stops at the time the light-shielding plate 9A of the lever gear 9 shields the optical sensor 14 to prevent light reception (in the position shown in FIG. 4A). Consequently, the supporting point position and angle of the manual paper feed tray 1 return to the default state.

In this embodiment as described above, it is possible to reliably separate and feed different types of paper sheets to the main body with an inexpensive simple mechanism which can be miniaturized without increasing the apparatus area.

Figure 8:
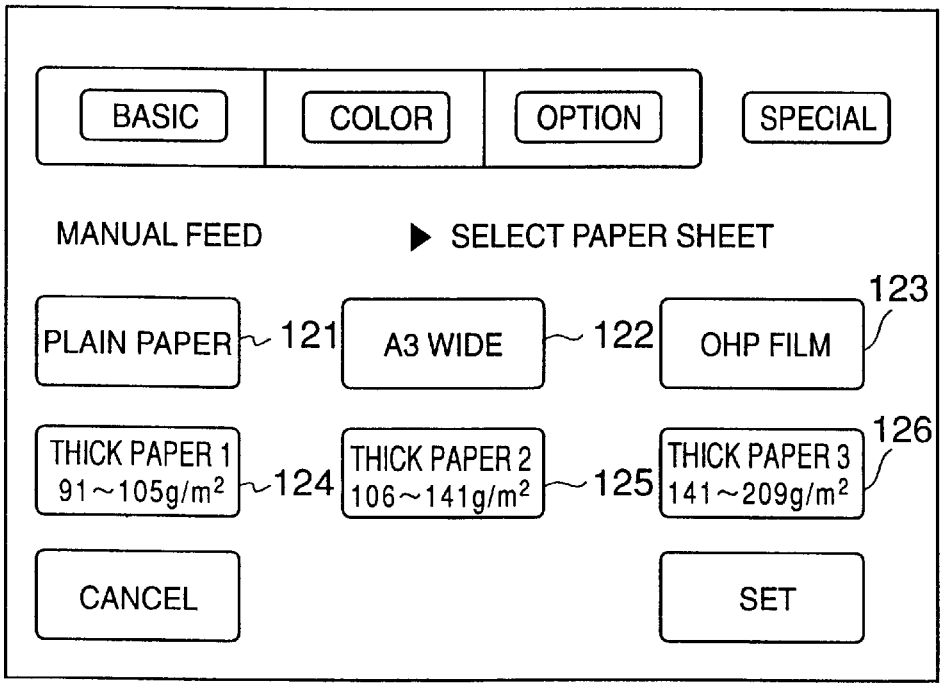
FIG. 8 is a plan view showing an example of the arrangement of buttons on an operation panel to which the present invention is applicable.

The types of paper sheets can also be selected as follows. For example, as shown in FIG. 8, on an operation panel on which various switches such as a plain paper switch 121, an A3 wide paper switch 122, an OHP film switch 123, a thick paper switch 124 (91 to 105 g/m$^2$), a thick paper switch 125 (106 to 141 g/mt$^2$), and a thick paper switch 126 (141 to 209 g/m$^2$) are arranged, an operator selects a switch corresponding to the basis weight of a paper sheet.

When an operator performs a simple operation of selecting the type of paper sheet on the operation panel, it is possible to automatically switch the supporting point positions and angles of the manual paper feed tray to realize an optimum paper feed/conveyance path for each of a plurality of types of paper sheets.

The abovementioned embodiment is merely an example and hence does not limit the present invention. For example, the mechanisms shown in FIGS. 1 to 7B and the operation panel shown in FIG. 8 are examples, so various modifications can be made without departing from the scope of claims. Also, external inputs for selecting the type of paper sheet need not be given by an operator on an operation panel but can be given manually.

What is claimed is:

1. An image forming apparatus comprising:

a manual paper feed tray, wherein a supporting point position and angle of said manual paper feed tray change in accordance with an external input, wherein said manual paper feed tray comprises:

a tray for stacking paper sheets;

a pair of supporting point members formed at two ends of a leading end portion in a conveyance direction of said tray, gears respectively being formed in at least a partial circumferential region centering around a first rotation supporting point;

a support shaft formed along the first rotation supporting point and having a pair of projections protruding from said supporting point members toward two ends;

a pair of rack guides fixed to a main body and having racks which mesh with the gears of said supporting point members and long holes elongated in one direction into which said projections are inserted;

a pair of lever gears which rotate around a second rotation supporting point while engaging, with play, with said projections inserted into said long holes and protruding toward two ends; and a driving source for rotating said lever gears, and when the external input is given, said driving source rotates said lever gears around the second rotation supporting point, said lever gears drive the projections engaged around the second rotation supporting point, the projections slidably move along the long holes in said rack guides fixed to the main body, and the position of the first rotation supporting point moves while said supporting point members rotate around the first rotation supporting point, thereby changing the supporting point position and angle of said manual paper feed tray.

2. An apparatus according to claim 1, wherein said driving source comprises a motor.

3. An apparatus according to claim 1, wherein said supporting point members have fan-shaped holes centering around the first rotation supporting point, said tray has fan-shaped projections to be inserted with play into the fan-shaped holes around the first rotation supporting point, and said tray is accommodated in the main body of said image forming apparatus when the fan-shaped projections pivot in the fan-shaped holes.

4. An image forming apparatus comprising:

a manual paper feed tray, wherein a supporting point position and angle of said manual paper feed tray change in accordance with an external input, wherein the external input is given when an operator performs a predetermined input operation on an operation panel, wherein said manual paper feed tray comprises:

a tray for stacking paper sheets;

a pair of supporting point members formed at two ends of a leading end portion in a conveyance direction of said tray, gears respectively being formed in at least a partial circumferential region centering around a first rotation supporting point;

a support shaft formed along the first rotation supporting point and having a pair of projections protruding from said supporting point members toward two ends;

a pair of rack guides fixed to a main body and having racks which mesh with the gears of said supporting point members and long holes elongated in one direction into which said projections are inserted;

a pair of lever gears which rotate around a second rotation supporting point while engaging, with play, with said projections inserted into said long holes and protruding toward two ends; and a driving source for rotating said lever gears, and when the external input is given, said driving source rotates said lever gears around the second rotation supporting point, said lever gears drive the projections engaged around the second rotation supporting point, the projections slidably move along the long holes in said rack guides fixed to the main body, and the position of the first rotation supporting point moves while said supporting point members rotate around the first rotation supporting point, thereby changing the supporting point position and angle of said manual paper feed tray.

5. An apparatus according to claim 4, wherein said driving source comprises a motor.

6. An apparatus according to claim 4, wherein said supporting point members have fan-shaped holes centering around the first rotation supporting point, said tray has fan-shaped projections to be inserted with play into the fan-shaped holes around the first rotation supporting point, and said tray is accommodated in the main body of said image forming apparatus when the fan-shaped projections pivot in the fan-shaped holes.

7. An image forming apparatus comprising:

a paper feed tray on which a paper sheet to be manually fed is placed, wherein a mounting position of said manual paper feed tray with respect to an apparatus main body is adjusted in accordance with the type of paper sheet placed on said manual paper feed tray, wherein said manual paper feed tray comprises:

a tray for stacking paper sheets;

a pair of supporting point members formed at two ends of a leading end portion in a conveyance direction of said tray, gears respectively being formed in at least a partial circumferential region centering around a first rotation supporting point;

a support shaft formed along the first rotation supporting point and having a pair of projections protruding from said supporting point members toward two ends;

a pair of rack guides fixed to a main body and having racks which mesh with the gears of said supporting point members and long holes elongated in one direction into which said projections are inserted;

a pair of lever gears which rotate around a second rotation supporting point while engaging, with play, with said projections inserted into said long holes and protruding toward two ends; and a driving source for rotating said lever gears, and when an external input is given, said driving source rotates said lever gears around the second rotation supporting point, said lever gears drive the projections engaged around the second rotation supporting point, the projections slidably move along the long holes in said rack guides fixed to the main body, and the position of the first rotation supporting point moves while said supporting point members rotate around the first rotation supporting point, thereby changing a supporting point position and angle of said manual paper feed tray.

8. An apparatus according to claim 7, wherein said driving source comprises a motor.

9. An apparatus according to claim 8, wherein said supporting point members have fan-shaped holes centering around the first rotation supporting point, said tray has fan-shaped projections to be inserted with play into the fan-shaped holes around the first rotation supporting point, and said tray is accommodated in the main body of said image forming apparatus when the fan-shaped projections pivot in the fan-shaped holes.

10. An apparatus according to claim 7, wherein said supporting point members have fan-shaped holes centering around the first rotation supporting point, said tray has fan-shaped projections to be inserted with play into the fan-shaped holes around the first rotation supporting point, and said tray is accommodated in the main body of said image forming apparatus when the fan-shaped projections pivot in the fan-shaped holes.

* * * * *